United States Patent [19]

Eriksen

[11] 4,232,435

[45] Nov. 11, 1980

[54] STRETCHING MACHINE FOR TREATING REMOVABLE BELTS SUPPORTED ON ROLLERS

[75] Inventor: Gunnar Eriksen, Asker, Norway

[73] Assignee: Thune-Eureka A/S, Tranby, Norway

[21] Appl. No.: 940,101

[22] Filed: Sep. 6, 1978

[51] Int. Cl.[2] ..... D06C 3/06

[52] U.S. Cl. ..... 26/106; 28/142; 162/273

[58] Field of Search ..... 26/106, 3, 6; 28/142; 38/12; 226/5; 219/469; 432/60, 65; 34/6, 7; 162/272, 273

[56] References Cited

U.S. PATENT DOCUMENTS

| | | | |
|---|---|---|---|
| 1,740,776 | 12/1929 | Murai et al. | 26/3 |
| 3,008,621 | 11/1961 | Mason | 26/2 R UX |
| 3,075,274 | 1/1963 | Mizel | 28/142 |
| 3,108,863 | 10/1963 | Limberger et al. | 34/7 X |
| 3,825,724 | 7/1974 | Kingsley et al. | 28/185 X |

FOREIGN PATENT DOCUMENTS

| | | | |
|---|---|---|---|
| 1226068 | 10/1966 | Fed. Rep. of Germany | 226/5 |
| 11738 | of 1905 | United Kingdom | 26/106 |

*Primary Examiner*—Robert Mackey
*Attorney, Agent, or Firm*—Young & Thompson

[57] ABSTRACT

A stretching machine for treating removable belts supported on rollers, such as felts and wires in paper-making machines. The stretching machine comprises two rollers over which the belt is suspended, at least one of said rollers being adapted to be heated. A lifting device is inserted between the heatable roller and the belt, such that the belt can be held raised up from the roller.

2 Claims, 3 Drawing Figures

STRETCHING MACHINE FOR TREATING REMOVABLE BELTS SUPPORTED ON ROLLERS

The invention pertains to an improvement on a stretching machine for treating removable belts supported on rollers, such as felts and wires in paper-making machines. Stretching machines of this type have two rollers over which the belt is suspended, the rollers being movable toward and away from each other on rails or the like. In addition, such stretching machines are usually provided with auxiliary components such as air-drying equipment, infra-red drying equipment and equipment for other required operations. On some machines, at least one of the rollers is adapted to be heated, usually by recirculating oil and to a temperature of 150°-250° C. The invention pertains to a stretching machine of this type, in which at least one roller can be heated. A problem that arises with the use of this type of heated roller in a stretching machine for e.g., felts and wires, is that attaching and removing the felt or wire takes a longer time than necessary because the hot roller requires a cooling period of at least ½ hour. Similarly, a heating period of the same order of magnitude is required to come up to the correct temperature again. Moreover, the belt, e.g. a wire or felt, should be removed from the hot roller as soon as possible following treatment to prevent its being burned.

According to the invention, therefore, it is proposed to provide a means on the stretching machine which can be inserted between the heatable roller and the belt, by means of which the belt can be held lifted up from the roller.

This lifting means can be used both when attaching and when removing the belt. During attachment, the belt is guided onto the lifting means and is subsequently brought into contact with the roller via a corresponding movement of the lifting means. The reverse occurs during removal. The particular advantage obtained with the invention is that the roller does not need to be cooled down, either out of consideration for operating personnel or out of consideration for the belt, because personnel do not come in contact with the roller and the belt can be set into motion on the stretching apparatus shortly after it has been placed on the roller. Similarly, the belt can be lifted off the roller as soon as the machine is stopped, such that the risk of burning the belt is avoided. One could of course also cool the roller down if desired, but in any case one would save time, because it would not be necessary to cool the roller as much as would otherwise be required if the new means were not present.

It is preferred that the lifting means be adapted to turn about the axis of rotation of the roller. Thus, the lifting means can be pivoted from a rest position between the two rollers into a working position in which the belt is held raised from the roller. The means can be pivoted by means that are known per se, e.g. two working cylinders, one at each end of the roller.

Preferably, the lifting means is formed as a shield running along the length of the roller and in cross section spanning at least a main portion of the roller circumference not covered by the belt. Because the shield surface facing away from the roller has a shorter radius of curvature than that of the roller surface, one will obtain a gradual lifting of the belt when the shield is pivoted from the rest position to the working position.

A preferred embodiment of the shield is characterized in that the surface of the shield which faces toward the roller has a larger radius of curvature than the surface facing away from the roller, such that, seen in cross section, the shield has a half-moon configuration. This provides the gradual lifting effect mentioned above, as well as a gradual lowering and positioning of the belt on the roller, while at the same time the shield structure is both simple and rigid.

The shield is affected by the hot roller and will therefore gradually become heated. To avoid the shield's becoming too hot, such that the shield burns the belt when the belt and shield are in contact, the inner surface of the shield is preferably insulated. Such insulation can also be used for other embodiments. The shield can also be provided with cooling ducts for the same purpose. These cooling ducts can be formed in the shield structure by providing axially parallel ribs interconnecting the two shield surfaces.

In addition to the above advantages, the shield will also protect other parts of the machine against the effects of heat from the roller. For example, if the known "cantilever construction" is used, the shield will protect the cantilever beam against the effects of heat from the hot roller. This is a substantial advantage, because experience has shown that heat effects can otherwise be so great that the cantilever beam becomes warped. For a more detailed description of a stretching machine utilizing a cantilever construction, see U.S. Pat. No. 3,596,372. Further details pertaining to known stretching apparatus can be found in U.S. Pat No. 3,588,972.

The invention will be further elucidated with reference to the drawings, where

Figure 1:
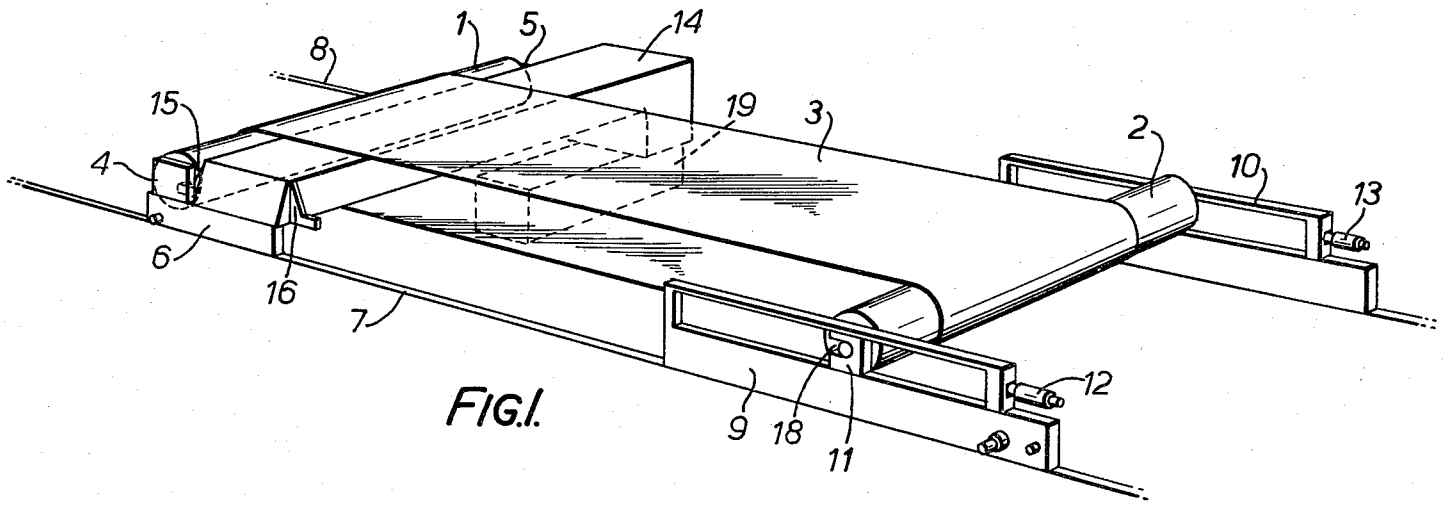
FIG. 1 is a perspective view of a stretching machine.

FIG. 1 shows only the essential components in a known stretching machine. The two rollers are designated 1 and 2. A belt 3 is trained around the rollers 1 and 2. The roller 1 is supported at each end in bearings 4 and 5. The roller 1 can be made to rotate in the bearings 4 and 5 by means of a drive motor (not shown). The bearing 4 is mounted on a carriage 6 which can be moved along the floor rail 7. The roller 2 is rotatably supported at each end in bearings 11 (only one is illustrated). The bearings 11 are adjustably mounted in the carriages 9, 10 by means of the illustrated drive motors 12, 13, which drive screw spindles (not shown) that cooperate with nuts in the bearings 11. The two carriages 9 and 10 can be moved on floor rails 7 and 8.

A U-shaped cantilever beam 14 is built into the apparatus, one of its legs being above the floor and one leg beneath the floor (passing through the floor at 19), extending parallel with the roller 1, between the two roller supports for the belt 3. The free end of the cantilever beam 14 extends out to the carriage 6. On the free end, the cantilever beam 14 is provided with two projecting support arms 15 and 16. The support member 15 cooperates with the forward shaft journal on the roller 1 at the bearing 4, while the support member 16 serves the same purpose for the forward shaft journal on the roller 2. When the roller 2 is driven in toward the cantilever beam by means of the carriages 9 and 10, the cantilever beam is raised by means of lifting members (not shown), whereby the support arms 15 and 16 are brought into engagement with the respective shaft journals on the rollers 1 and 2 and assume support of the rollers. Prior to this, of course, the shaft journals have been released from their respective bearings 4 and 11. The bearings 11 can be opened (at 18), and after the cantilever beam 14 has assumed the support function at the front of the roller 2, the carriage 9 can be driven away on the rails 7. Similarly, the carriage 6 with the bearing 4 can be driven away on the rail 7, such that one has free access to the rollers from the side and can thus easily affix or remove the belt.

A stretching machine of this general type can comprise different pieces of equipment for treatment of the belt. For example, it can be provided with an air-drying assembly, which then can advantageously be built into the cantilever beam. Infra-red drying equipment can also be used. The roller 1 can also be adapted to be heated, and as mentioned previously, the invention pertains to a stretching machine in which at least one of the rollers can be heated. The apparatus of the invention is shown in greater detail in FIGS. 2 and 3, which are perspective detail views of the region of the roller 1 in the stretching machine of FIG. 1. The same reference numbers are used for components that are illustrated both in FIG. 1 and in FIGS. 2 and 3. The lifting means of the invention has not been shown in FIG. 1 in order that the basic stretching machine can better be seen.

Figure 2:
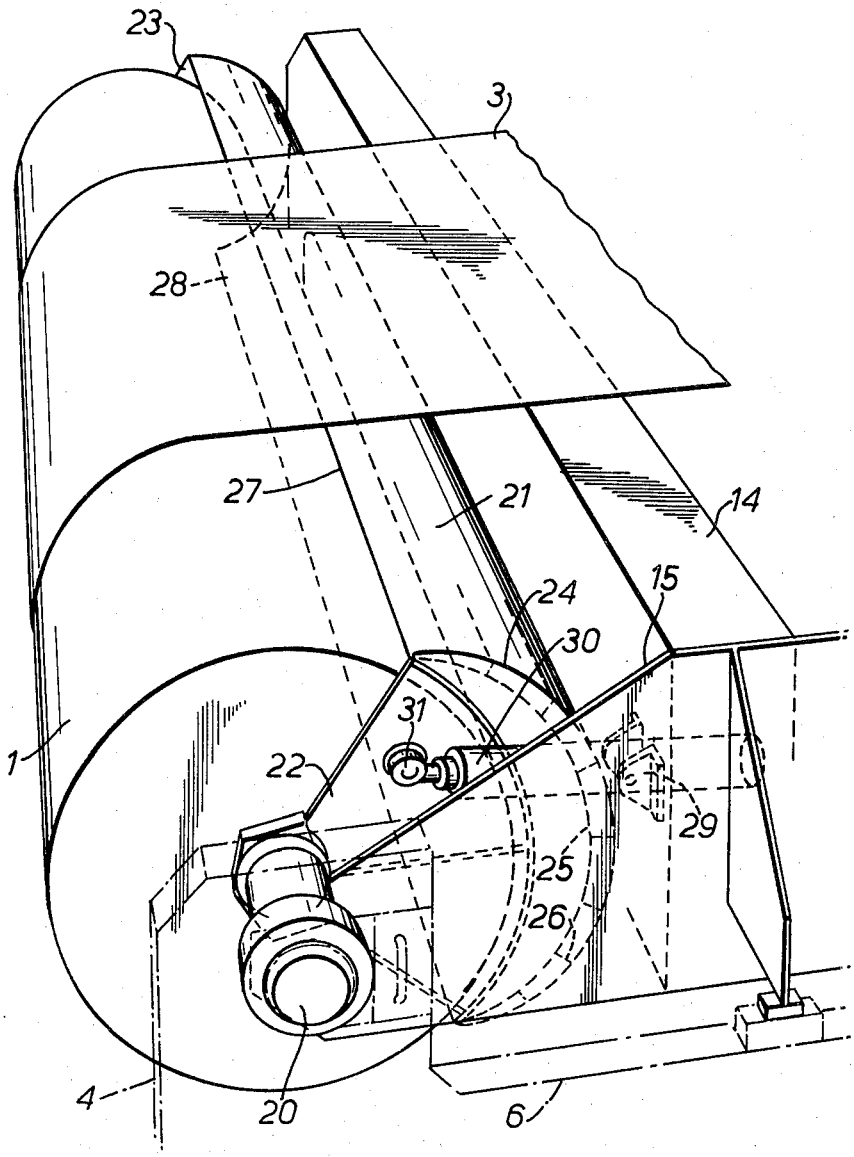
FIG. 2 shows the left-hand end of the machine of FIG. 1 in perspective.
Figure 3:
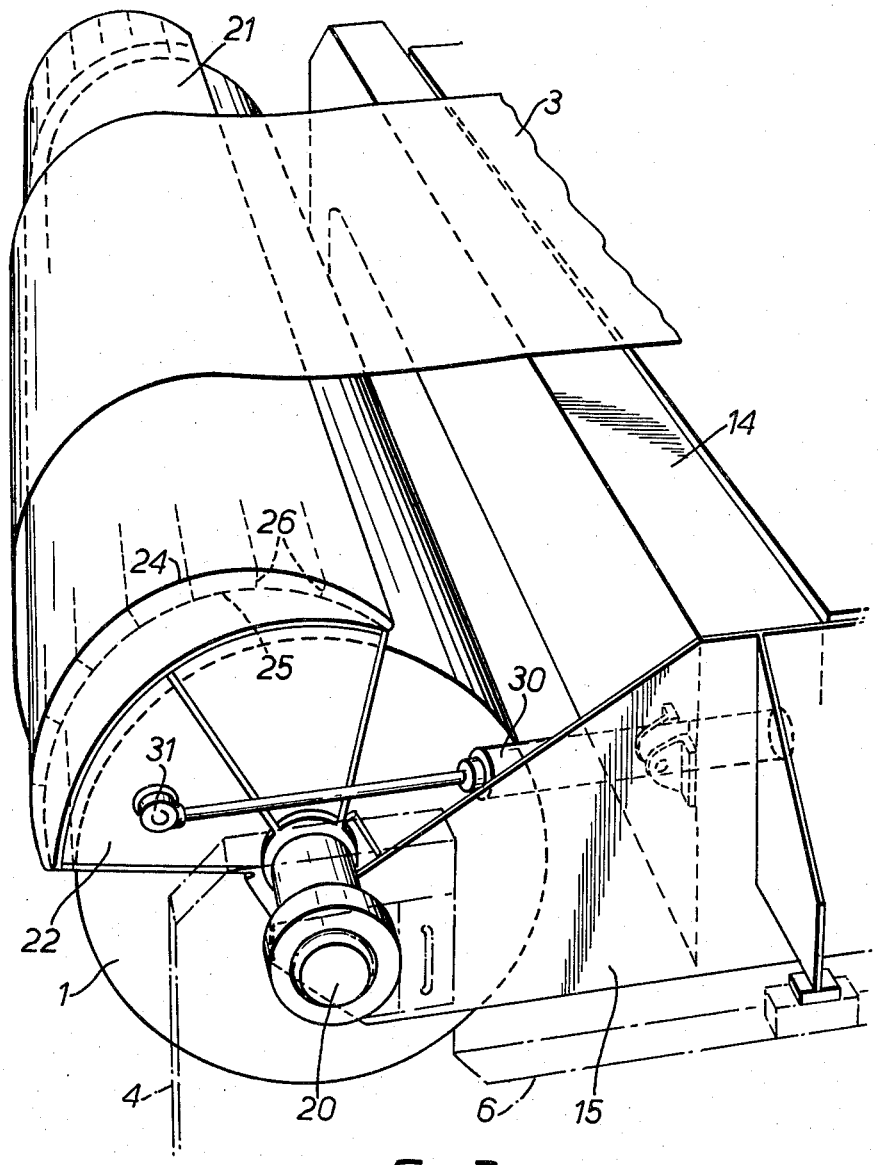
FIG. 3 is a perspective view, as in FIG. 2, but with the shield in the working position.

In FIGS. 2 and 3, a portion of the cantilever beam 14 is shown, with its associated roller support member 15. The carriage 6 and bearing 4 for the roller are drawn with broken lines for the sake of clarity. The roller 1, as can be seen on the drawings, is supported in the bearing 4 by means of a shaft journal 20. The other end of the roller is similarly supported in a bearing 5. A shield 21 extends parallel with the roller 1 and is supportingly journalled on the roller's shaft journals 20 by means of respective segment-shaped brackets 22, 23. Seen in the axial direction of the roller, i.e., in cross section, the shield has an extension which spans over a main portion of the free circumference of the roller. The shield 21 is formed as a double-walled plate structure, having an outer curved plate 24 and an inner curved plate 25 with ribs 26 disposed therebetween. The outer plate 24 has a shorter radius of curvature than the inner plate 25, and the plates meet along the edges 27 and 28, respectively, such that, seen in cross section, the shield has approximately a half-moon configuration. Longitudinal channels are formed between the stiffening ribs 26 which can advantageously be used as cooling ducts.

The shield is preferably insulated, for example, by means of a layer of insulation (not shown) on the inner plate 25.

A hydraulic working cylinder 30 is rotatably mounted in suitable brackets 29 on the cantilever beam 14. The working cylinder is pivotally connected at 31 to the support bracket 22 for the shield. A corresponding working cylinder is found at the other end of the roller shield.

In FIG. 2, the shield has been pivoted down into a rest position between the two rollers, and the belt 3 is therefore in contact with the roller 1. When the apparatus is stopped, the shield 21 can be pivoted by means of the cylinders 30 which can be controlled in any desired manner, manually or automatically, into the working position shown in FIG. 3. The shield, owing to its special half-moon configuration (in cross section), will effect a gradual release and lifting of the belt 3 away from the roller 1. The belt 3 has of course already been slackened by a corresponding movement of the roller 2. The roller 1 can be released from its bearing 4 and temporarily supported by the cantilever beam 14. The bearing 4 can then be driven away by means of the carriage 6, and since the roller 2, as mentioned previously, is also temporarily supported on the cantilever beam, one has free access to the belt 3 from the side so that it can be detached without difficulty from the rollers. The shield protects both the operating personnel and the belt from the hot roller, so the relatively long and loss-producing cooling period previously required for the roller 11 can be avoided. The shield, in the position shown in FIG.2, will also serve as a heat shield for the cantilever beam 14, such that the effects of the heat will not cause it to warp.

When a belt is to be attached to the rollers, the shield is preferably brought into the position shown in FIG. 3, if the roller 1 is hot, and the shield is then pivoted into the position shown in FIG. 2, to bring the belt into contact with the roller.

Having described my invention, I claim:

1. In a stretching machine for treating removable belts supported on rollers, such as felts and wires in papermaking machines, the stretching machine comprising two rollers over which the belt is suspended, means to heat at least one of said rollers, and means to move one of the rollers toward the other to slacken the belt for removal from the rollers; the improvement comprising lifting means adapted to be inserted between the heated roller and the belt, such that the belt can be held raised up from the roller, the lifting means being pivotable about the axis of rotation of the heated roller and being formed as a shield running along the length of the roller and, seen in cross section, spanning at least a main portion of the roller circumference that is not covered by the belt, cooling ducts in the shield and means for pivoting the shield from a rest position between the two rollers into a protective working position in which the belt is held raised from the heated roller.

2. A stretching machine according to claim 1, characterized in that the cooling ducts are formed by axial, parallel ribs disposed between two shield surfaces.

* * * * *